United States Patent [19]

Patrick

[11] Patent Number: 4,580,752

[45] Date of Patent: Apr. 8, 1986

[54] ANTI-SWAY DEVICE

[76] Inventor: Robert W. Patrick, 17653 65th Ave., Tinley Park, Ill. 60477

[21] Appl. No.: 658,193

[22] Filed: Oct. 5, 1984

[51] Int. Cl.[4] ..... E06C 7/14

[52] U.S. Cl. ..... 248/210; 182/129; 248/249

[58] Field of Search ..... 248/210, 211, 249; 182/129, 230

[56] References Cited

U.S. PATENT DOCUMENTS

| | | | |
|---|---|---|---|
| 1,406,087 | 2/1922 | Ryan | 248/211 |
| 1,772,392 | 8/1930 | Firl | 248/210 |
| 3,239,180 | 3/1966 | Bachmann | 248/210 |
| 3,335,991 | 8/1967 | Epple | 248/211 |
| 4,433,822 | 2/1984 | Caggiano | 248/210 |

FOREIGN PATENT DOCUMENTS

| | | | |
|---|---|---|---|
| 695251 | 8/1940 | Fed. Rep. of Germany | 248/211 |

*Primary Examiner*—Reinaldo P. Machado
*Attorney, Agent, or Firm*—Gordon W. Hueschen

[57] ABSTRACT

There is disclosed an anti-sway device for paint buckets suspended from the rung of a ladder, in which the bucket is engaged by a loop which is connected to hooks adapted to engage a rung of the ladder by a rigid connection and minimize the sway of the bucket. The device is formed out of a single strand of wire and the loop has such size and sufficient resiliency that it can be spread to encompass the bucket and spring back into engagement therewith.

12 Claims, 6 Drawing Figures

ANTI-SWAY DEVICE

BACKGROUND OF THE INVENTION

1. Field of the Invention and Prior Art

This invention relates to an anti-sway device and is particularly directed to an anti-sway device for paint buckets suspended from a rung of a ladder.

Paint buckets are commonly suspended from a ladder during painting from a hook adapted to hook over a rung and to hold the bucket in position convenient for the painter. Such devices have a difficulty, however, in that it is sometimes necessary to use two hands in order to dip the paint brush into the paint and wipe it off along the rim of the bucket. Such wiping tends to cause the bucket to sway which, especially if the bucket is too full, may cause spillage.

When a bucket is suspended as described above, moreover, it is difficult to move the ladder without first taking the bucket off the hook. Sometimes, especially when only a short move is needed, the painter is tempted to leave the bucket on the hook. Sometimes this results in spillage.

The present invention is directed to solving this problem and does so by means of an anti-sway device to hold the bucket against swaying in either of the situations mentioned above.

SUMMARY OF THE INVENTION

The invention relates to an anti-sway device for paint buckets suspended from a rung of a ladder which comprises bucket-engaging means, ladder-engaging means, and anti-sway means connecting said bucket-engaging means and said ladder-engaging means.

The invention also comprises one or more further features in which said anti-sway means comprises a rigid elongate member having a relatively short portion connected to said bucket-engaging means and a relatively long portion connected to said ladder-engaging means, said portions forming an obtuse angle such that, in use, said short portion extends substantially horizontally to said bucket-engaging means and said long portion extends downwardly substantially parallel to said ladder; in which said ladder-engaging means comprises rung-engaging means adapted, in use, to engage a rung of the ladder which is below said bucket; in which said rung-engaging means comprises a hook member adapted to hook on a rung from the top thereof; and in which said hook member is bifurcated and rigidly connected to said stabilizing means so that any tendency of the anti-sway means to sway brings first one hook into play and then the other hook into play.

The invention also comprises one or more further features in which in which said bucket-engaging means comprises a loop of resilient material having flattened, substantially parallel side-engaging members, said flattened sides being spaced apart somewhat less than the diameter of a bucket and being adapted to be spread apart to admit the bucket and having sufficient resiliency to engage the bucket when released into contact therewith, in which said loop, said ladder-engaging means and said anti-sway means comprise a unitary wire strand; in which the unitary wire strand is bent in the mid-portion thereof to form said loop, then twisted together to form said anti-sway means, and then bent to form said ladder-engaging means; in which said ladder-engaging means is formed by bending the two ends of the wire strand into spaced-apart hooks adapted to hook over a rung of the ladder; in which said hooks have plastic grips thereon adapted to grip the rung; and, in which the twisted portion forming said anti-sway means comprises a relatively short, straight portion substantially in the plane of said loop and a relatively long, staight portion forming an obtuse angle with the plane of said loop such that, in use, said short portion extends substantially horizontally to said bucket-engaging means and said long portion extends downwardly substantially parallel to said ladder.

The invention is also directed to an anti-sway device for a paint bucket suspended from a rung of a ladder which comprises a loop of resilient material adapted to be sprung into engagement with the side walls of said bucket, said loop when so engaged lying substantially in a horizontal plane, and connecting means for connecting said loop to a rung below said bucket, said connecting means comprising rung-engaging means and a rigid member having a relatively short portion projecting outwardly from said loop in the plane thereof and a relatively long portion projecting downwardly therefrom to said rung-engaging means, said relatively long portion forming an acute angle with the vertical which is substantially coincident with and not greater than the acute angle that the ladder forms with the vertical.

DESCRIPTION OF THE PREFERRED EMBODIMENTS

Figure 1:
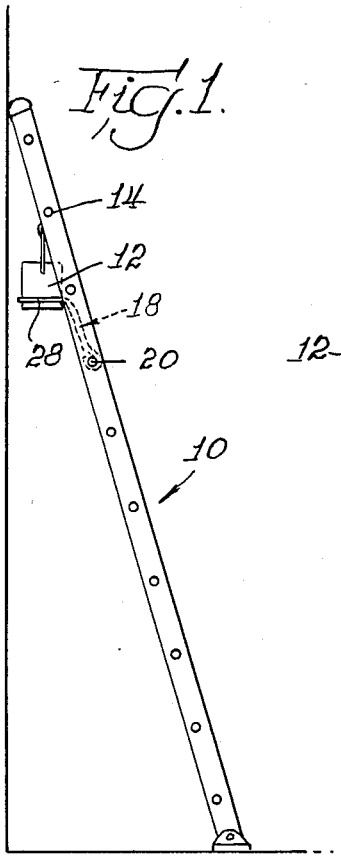
FIG. 1 is a side elevation showing the device of the invention in use.
Figure 2:
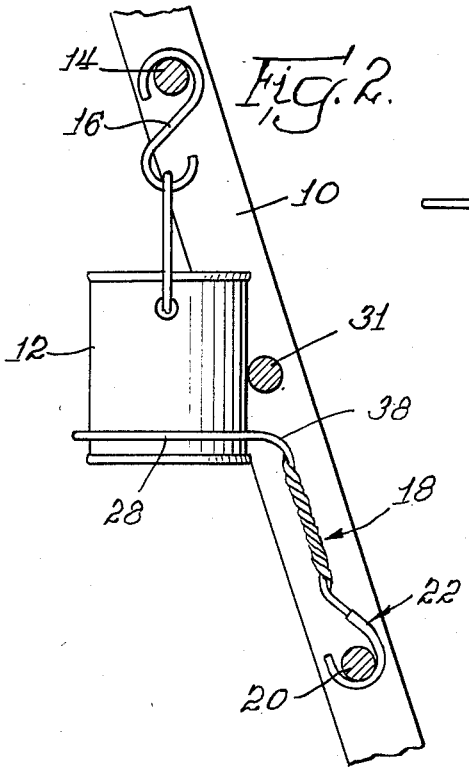
FIG. 2 is a partial section of FIG. 1.

In FIGS. 1 and 2, there is shown a ladder with a paint bucket 12 suspended from rung 14 by a hook 16 with an anti-sway device 18 of the invention fastened to the bucket 12 and hooked onto rung 20 by the hook 22.

Figure 3:
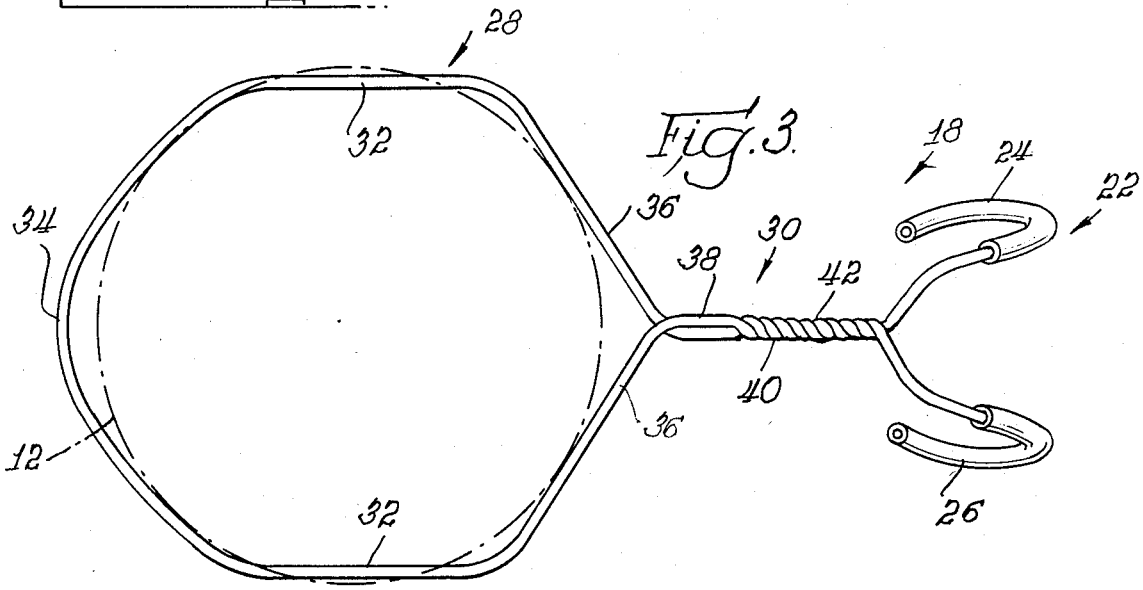
FIG. 3 is a plan view of the device of the invention.

The hook 22 is bifurcated; that is to say, it has two hook portions 24 and 26 spaced apart, as shown in FIG. 3. A single hook can be used, if desired, but the bifurcated, or double hook, provides additional anti-sway capability to the device.

The anti-sway device 18 is provided with a loop portion 28 which is connected with the hook portion 22 by a rigid member 30 of sufficient length that when the loop portion 28 is engaged with the bucket 12, the hook portion 22 is in position to engage over the rung 20. Thus, the rung 14 supports the bucket 12, another rung 31 is opposite the bucket and may or may not touch the bucket 12, depending on the slope of the ladder 10, and the third rung down is engaged by the hook portion 22.

The hook portion 22 has a bent-in hook, or hooks, so that it hooks over the rung from the outside and the hook, or hooks may be covered with rubber or plastic tubing so as to provide a better grip of the hook, or hooks, on the rung. Also, the hook, or hooks, can have a curvature which corresponds to the curvature of the rung to enhance the gripping action.

When a bifurcated hook 24–26 is used, the anti-sway action is enhanced because any tendency of the bucket 12 to sway causes the anti-sway member 18 (rigid member 30) to rock abut the hooks 24 and 26, first one hook and then the other coming into play.

The loop member 28 is bent at an angle to the anti-sway member 18, as best seen in FIG. 2, so that the plane of the loop portion 28 lies in the plane of the bottom of the bucket 12, as best seen in FIG. 2.

The loop member 28 has flattened sides 32 which are essentially parallel one to the other and are oriented so that they and the anti-sway member 30 lies in parallel planes. The side members 32 are spaced apart, as best seen in FIG. 3, a distance somewhat less than the diameter of the bucket 12. This, coupled with the loop 28 being made of resilient material, such as wire, makes it possible to spring the sides 32 apart so that the loop can be slipped over the bucket 12 and the sides then spring back into engagement with the sides of the bucket 12.

Advantageously, the device is made of a single strand of resilient wire which is bent at the middle thereof to form a bight 34, the sides 32, and the end pieces 36 to form the loop 28 whence they extend outwardly side by side to form the top portion 38 of the anti-sway member 30. The strands are then twisted together, as shown at 40, to form the downwardly-sloping portion 42. The downwardly-sloping portion 42 can be bent either before or after the twisting. It is bent at an angle so that it is generally parallel with the front and rear edges of the ladder. The overall length of the anti-sway portion is somewhat less than the distance between the rungs of the ladder, as best seen in FIG. 2.

Figure 4:
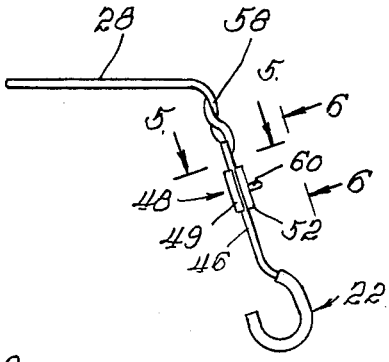
FIG. 4 is a partial view of a modified form.
Figure 5:
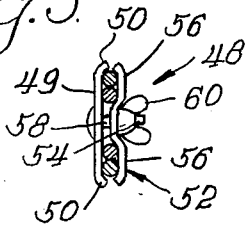
FIG. 5 is a section taken on line 5—5 of FIG. 4.
Figure 6:
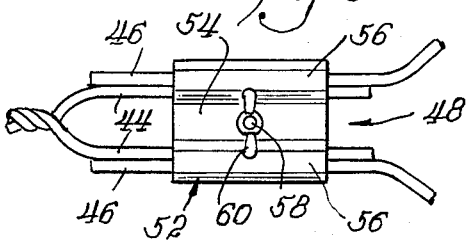
FIG. 6 is a partial view taken from line 6—6 of FIG. 4.

If desired, the anti-sway device of the invention can be modified, as shown in FIGS. 4, 5, and 6, to make the anti-sway member 18 extensible. For this purpose, the twisting of the portion 42 is terminated considerably before the hooks 24 and 26 in two parallel end portions 44 and the hooks 24 and 26 have corresponding parallel portions 46 which can be clamped to the parallel portions 44 by a suitable clamp 48, which in the form shown, comprises a base-plate 49 having upturned edges 50 and a face-plate 52 having a central web 54 and two parallel channels 56 adapted to span the end portions 44 and 46 when lying side-by-side, as best seen in FIG. 6, and to clamp them against the base-plate 48, as best seen in FIG. 5. A suitable clamping means comprises the bolt 58 and the wing nut 60. If desired, the end pieces 46 can be twisted together in the same way that the end pieces 44 are twisted together, or otherwise fastened together, to make the two hooks 24 and 26 and the end pieces 46 into a unitary structure.

Thus, there is provided an anti-sway device for a paint bucket suspended from a rung of a ladder which comprises bucket-engaging means, ladder-engaging means, and anti-sway means rigidly connecting the bucket engaging means and the ladder-engaging means and other features, as pointed out in the summary of the invention.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. An anti-sway device for paint buckets suspended from a rung of a ladder which comprises bucket-engaging means, ladder-engaging means, and anti-sway means connecting said bucket-engaging means and said and said ladder-engaging means, in which said anti-sway means comprises a rigid elongate member having a relatively short portion connected to said bucket-engaging means and a relatively long portion connected to said ladder-engaging means, said portions forming an obtuse angle such that, in use, said short portion extends substantially horizontally to said bucket engaging means and said long portion extends downwardly substantially parallel to said ladder.

2. An anti-sway device of claim 1, in which said ladder-engaging means means comprises rung-engaging means adapted, in use, to engage a rung of the ladder which is below said bucket 3. An anti-sway device of claim 2, in which said rung-engaging means comprises a hook member adapted to hook on a rung from the top thereof.

4. An anti-sway device of claim 1, in which said hook member is bifurcated and rigidly connected to said stabilizing means so that any tendency of the anti-sway means to sway brings first one hook into play and then the other hook into play.

5. An anti-sway device for paint buckets suspended from a rung of a ladder which comprises bucket-engaging means, ladder-engaging means, and anti-sway means connecting said bucket-engaging means and said ladder-engaging means, in which said bucket-engaging means comprises a loop adapted to surround said bucket and to engage the side walls thereof, and in which said loop is of resilient material having flattened, substantially parallel side-engaging members, said flattened sides being spaced apart somewhat less than the diameter of a bucket and being adapted to be spread apart to admit the bucket and having sufficient resiliency to engage the bucket when released into contact therewith.

6. An anti-sway device for a paint bucket which hangs freely suspended from a rung of a ladder which comprises bucket-engaging means, ladder-engaging means, and anti-sway means connecting said bucket-engaging means and said ladder-engaging means, in which said bucket-engaging means comprises a loop adapted to completely surround said bucket and to engage the side walls thereof, and in which said loop, said ladder-engaging means and said anti-sway means comprise a unitary structure essentially composed of a unitary wire strand.

7. An anti-sway device for paint buckets suspended from a rung of a ladder which comprises bucket-engaging means, ladder-engaging means, and anti-sway means connecting said bucket-engaging means and said ladder-engaging means, in which said bucket-engaging means comprises a loop adapted to surround said bucket and to engage the side walls thereof in which said loop, said ladder-engaging means and said anti-sway means comprise a unitary wire strand, and in which the unitary wire strand is bent in the mid-portion thereof to form said loop then twisted together to form said anti-sway means and then bent to form said ladder-engaging means.

8. An anti-sway device of claim 7, in which said ladderengaging means is formed by bending the two ends of the wire strand into spaced-apart hooks adapted to hook over a rung of the ladder.

9. An anti-sway device of claim 7, in which the twisted portion forming said anti-sway means comprises a relatively short, straight portion substantially in the plane of said loop and a relatively long, straight portion forming an obtuse angle with the plane of said loop such that, in use, said short portion extends substantially horizontally to said bucket-engaging means and said long portion extends downwardly substantially parallel to said ladder.

10. An anti-sway device of claim 8, in which said hooks have plastic grips thereon adapted to grip the rung.

11. An anti-sway device for a paint bucket suspended from a rung of a ladder which comprises a loop of material adapted to engage the side walls of said bucket, said loop when so engaged lying substantially in a horizontal plane, and connecting means for connecting said loop to a rung below said bucket, said connecting means comprising rung-engaging means and a rigid member having a relatively short portion projecting outwardly from said loop in the plane thereof and a relatively long portion projecting downwardly therefrom to said rung-engaging means, said relatively long portion forming an acute angle with the vertical which is substantially coincident with and not greater than the acute angle that the ladder forms with the vertical.

12. An anti-sway device of claim 11, in which said loop is of resilient material adapted to be sprung into engagement with the side walls of the bucket.

* * * * *

UNITED STATES PATENT AND TRADEMARK OFFICE

CERTIFICATE OF CORRECTION

PATENT NO. : 4,580,752

DATED : April 8, 1986

INVENTOR(S) : Robert W. Patrick

It is certified that error appears in the above-identified patent and that said Letters Patent is hereby corrected as shown below:

Col. 1, line 54; delete "in which" (second occurrence)

Col. 3, line 67; delete "and said"

Col. 4, line 6; "bucket engaging" should read -- bucket-engaging--

Col. 4, line 10; delete "means" (second occurrence)

Col. 4, line 12; insert a period -- . -- after "bucket"

Col. 4, lines 58 & 59; "ladderengaging" should read -- ladder-engaging --

Signed and Sealed this

*Ninth* Day of *September 1986*

[SEAL]

*Attest:*

DONALD J. QUIGG

*Attesting Officer*

*Commissioner of Patents and Trademarks*